United States Patent [19]

Makimoto et al.

[11] 4,059,815

[45] Nov. 22, 1977

[54] COAXIAL CAVITY RESONATOR

[75] Inventors: Mitsuo Makimoto; Sadahiko Yamashita, both of Kawasaki, Japan

[73] Assignee: Matsushita Electric Industrial Co., Limited, Japan

[21] Appl. No.: 710,207

[22] Filed: July 30, 1976

[30] Foreign Application Priority Data

July 31, 1975 Japan ..... 50-94031
July 31, 1975 Japan ..... 50-94032

[51] Int. Cl.[2] ..... H01P 1/30; H01P 7/04
[52] U.S. Cl. ..... 333/82 BT; 333/73 R
[58] Field of Search ..... 333/73 R, 73 W, 82 B, 333/82 BT, 83 T

[56] References Cited

U.S. PATENT DOCUMENTS

| | | | |
|---|---|---|---|
| 2,124,029 | 7/1938 | Conklin et el. | 333/82 BT |
| 2,543,246 | 2/1951 | Landon et al. | 333/82 B |
| 2,594,037 | 4/1952 | Landon et al. | 333/82 B |
| 3,273,083 | 9/1966 | Rose | 333/73 R |
| 3,668,551 | 6/1972 | Kondo | 333/83 T |

*Primary Examiner*—Paul L. Gensler
*Attorney, Agent, or Firm*—Robert E. Burns; Emmanuel J. Lobato; Bruce L. Adams

[57] ABSTRACT

An improved coaxial cavity resonator comprises an enclosed conductor having opposed ends, and a center cylindrical conductor in the enclosed conductor. The center conductor has smaller and larger diameter portions having respective first and second characteristic impedances. The smaller diameter portion is in contact with one end of the enclosed conductor and has a larger characteristic impedance than the larger diameter portion.

10 Claims, 7 Drawing Figures

COAXIAL CAVITY RESONATOR

BACKGROUND OF THE INVENTION

This invention relates to an improved coaxial cavity resonator.

While a variety of coaxial cavity resonators are known, it is desirable to provide a higher Q factor for a given set of resonator dimensions since the Q factor of a cavity is a measure of its ability to store energy. The prior art coaxial cavity resonator which provides the highest Q factor comprises a cylindrical enclosure and a center conductor contacting at one end with one end wall of the enclosure and a pair of opposed plates between the open end of the center conductor and the other end wall of the enclosure.

SUMMARY OF THE INVENTION

It is an object of the present invention to provide an improved coaxial cavity resonator having a higher Q factor than is available with the prior art devices.

Another object is to achieve the compactness of a coaxial cavity resonator.

A further object is to provide an improved coaxial cavity resonator in which there is provided a dielectric temperature compensation element of which the dielectric constant has a negative temperature coefficient.

Briefly stated, one embodiment of the invention comprises an outer conductive cylindrical enclosure and an inner or center cylindrical conductor shaped into smaller and larger diameter portions. The smaller diameter portion has a larger characteristic impedance than the larger diameter portion and has its end connected to the reflective end wall of the enclosure. The smaller diameter portion is considered to act as distributed inductances while the larger diameter portion acting as distributed capacitances along the path of wave propagation. To provide compactness of the cavity resonator, it was found necessary that it is the smaller diameter portion that is in short-circuit connection with the outer member. In another embodiment, a dielectric annular temperature compensation element encircles the larger diameter portion of the center conductor. The dielectric constant of the compensator has a negative temperature coefficient, and the axial dimension of the annular dielectric body and its position relative to the reflective end wall are so determined that any increment in resonant frequency due to temperature variation is cancelled.

BRIEF DESCRIPTION OF THE DRAWINGS

For a clearer understanding of the invention reference may be made to the following detailed description and the accompanying drawings, in which.

DESCRIPTION OF THE PREFERRED EMBODIMENTS

Figure 1:
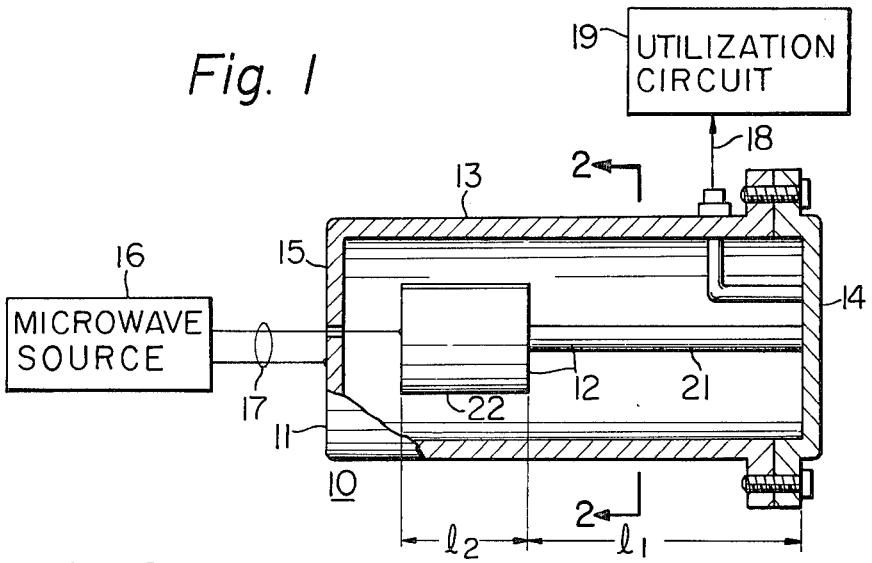
FIG. 1 is a side view of a preferred embodiment of the invention.
Figure 2:
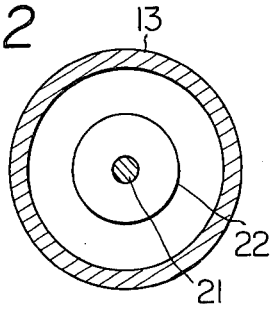
FIG. 2 is a cross-sectional view taken along lines 2—2 of FIG. 1.

In FIGS. 1 and 2, a microwave cavity resonator 10 constructed in accordance with the present invention comprises an outer conductor or enclosure 11 which is shown as a tubular construction and a cylindrical inner or center conductor 12 coaxial with the outer conductor. Outer conductor 11 includes side wall 13 and a pair of opposed end plates 14 and 15. Inner conductor 12 has a first or smaller diameter portion 21 adjacent the end plate 14 and a second or larger diameter portion 22 farthest therefrom. Through the end plate 15 microwave energy from a source 16 is coupled to the inner and outer conductors by means of connections 17 schematically shown. The smaller diameter portion 21 is in short-circuit connection with the end plate to permit reflection of the propagating microwave energy from the short-circuit end of the inner conductor 12. The end of the larger diameter portion 22 is spaced from the end plate 15 to provide an open circuit reflection of the energy therefrom. The microwave energy propagating axially through the inner and outer conductors is reflected back from the end plate 14 and further reflected from the open end of the inner conductor. Energy extracting means 18 couples the energy inside the cavity resonator to a utilization circuit 19 and is formed by a pair of conductors which extends through the side wall 13 into the cavity to form a loop in conventional manner. The smaller and larger diameter portions 21, 22 are considered as inductive and capacitive elements respectively of distributed constants. The spacing between the open end of the inner conductor and the end plate 15 has a capacitance as a lumped constant which is much smaller than the distributed capacitance. As a result of the presence of distributed constants along the path of wave propagation a standing wave occurs along the inner conductor 12 at the resonance frequency.

It will be noted that the direction of stepping of the diameter of inner element 12 is the key to the compactness and increased Q value of the cavity resonator. For a discussion of the proportions of element 12, consider the input impedance $Z_i$ of the resonator which is given by the following equation:

$$Z_1 = Z_2 \frac{j Z_1 \tan\beta_1 l_1 + j Z_2 \tan\beta_1 l_2}{Z_2 - Z_1 \tan\beta_1 l_1 \cdot \tan\beta_2 l_2} \quad (1)$$

where, $Z_1$ = characteristic impedance of smaller diameter portion 21, $Z_2$ = characteristic impedance of larger diameter portion 22, $l_1$ = axial length of smaller diameter portion 21, $l_2$ = axial length of larger diameter portion 22, $\beta_1$ = phase constant of smaller diameter portion 21, $\beta_2$ = phase constant of larger diameter portion 22, Equation (1) is obtained by neglecting the inappreciable amount of capacitance between the open end of inner conductor 12 and the end plate 15 of outer conductor 11. From Equation (1) it follows that resonance occurs when the input impedance becomes infinity so that the following equation must be satisfied:

$$\frac{Z_2}{Z_1} = \tan\beta_1 l_1 \tan\beta_2 l_2 \quad (2)$$

Since $\beta_1$ and $\beta_2$ are considered to be equal each other for the microwave energy propagating the atmosphere, $$\frac{Z_2}{Z_1} = \tan\beta l_1 \tan\beta l_2 \quad (3)$$

where $\beta = 2\pi$/the wavelength of microwave energy.

From Equation (3), the minimum length $l_{min}$ of inner conductor 12 is obtained by $$l_{min} \geqq \frac{1}{\beta} \tan^{-1} \left( \frac{2\sqrt{K}}{1-K} \right) \quad (4)$$

where, $K = Z_2/Z_1$. It will be noted from Equation (4) that the impedance ratio K is equal to or smaller than unity so that the smaller diameter portion 21 must have a greater characteristic impedance than the larger diameter portion 22. When both smaller and larger diameter portions 21, 22 have equal axial lengths, the minimum length $l_{min}$ of the inner element 12 is given by $$l_{min} = \frac{1}{2\beta} \tan^{-1} \sqrt{K} \quad (5)$$

Figure 6:
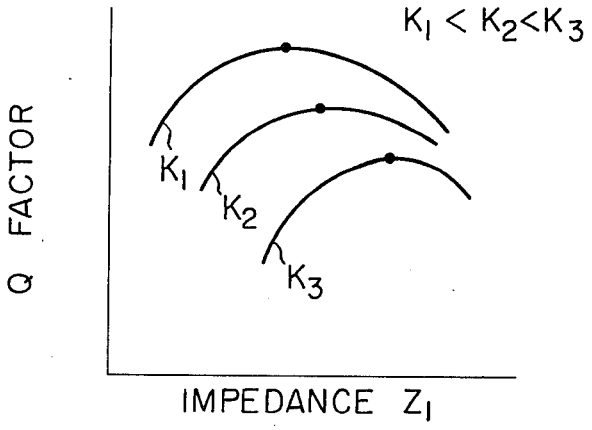
FIG. 6 is a graph illustrating the Q factor as a function of the characteristic impedance of the smaller portion of inner conductor.

Reference is now made to FIG. 6 in which the Q value of resonator 10 according to the invention is plotted as a function of characteristic impedance $Z_1$ for different ratios $K_1$, $K_2$ and $K_3$ shown as parameters in curves having respective peak values each corresponding to a particular impedance value $Z_1$ of smaller diameter portion 21, wherein $K_1 < K_2 < K_3$. With the axial lengths of the smaller and larger diameter portions determined at arbitrary values, the K value is obtained from Equation (4) or (5), and therefore from FIG. 6, the optimum value for $Z_1$ is obtained. With the values for K and $Z_1$ being determined, $Z_2$ can be obtained.

One device constructed in accordance with FIG. 1 employed a tube of conductor 18 millimeters in diameter, a smaller portion of the inner conductor 2.1 millimeters in diameter and 22 millimeters in length, and a larger diameter portion 11.7 millimeters in diameter and 22 millimeters in length. The characteristic impedances $Z_1$ and $Z_2$ were 130 and 26 ohms, respectively, with the K value being 0.2 for resonant frequency of 800 MHz. With these parameters, a Q factor of 1,250 was obtained. This value is favorably compared with a Q factor of less than 825 obtained with the prior art resonator using a uniform inner conductor having a characteristic impedance of 77 ohms and a pair of plates provided between the open end of the inner conductor and the adjacent end wall of the outer conductor to form a lumped capacitance. Because of the high Q factor, good oscillation stability and high carrier-to-noise ratio were obtained.

It is to be noted that the outer conductor 11 may take any transverse configuration other than circular.

Conventional methods can be employed for coupling microwave energy to the resonator and extracting it therefrom. The locations of the coupling means 17 and extracting means 18 are not restricted to those shown in FIG. 1.

Figure 3:
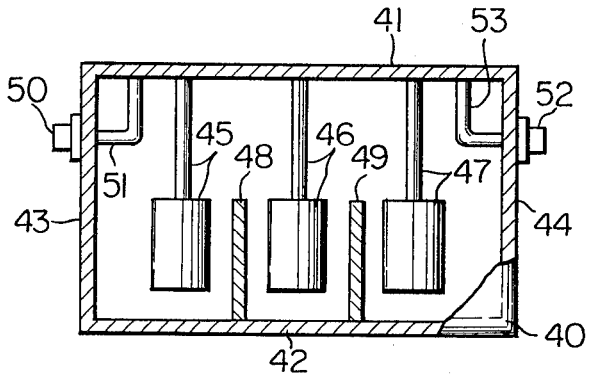
FIG. 3 is an example illustrating the application of the present invention to a microwave band-pass filter.

The cavity resonator embodying the invention can also be used in filter applications where a wanted signal at a desired frequency or desired range of frequencies is extracted from input signals. FIG. 3 illustrates one example of such applications which includes an outer conductive body or enclosed structure 40 having top and bottom walls 41, 42 and side walls 43, 44 and a set of three inner conductors 45, 46 and 47 arranged parallel to each other. As many inner conductors as required can be provided to encompass a desired range of frequencies. Each of the inner conductors is suspended from the top wall 41 with the smaller diameter portion connected thereto and the larger diameter portion being spaced from the bottom wall 42. Shielding plates 48 and 49 are juxtaposed on the bottom wall 42 to isolate the outer diameter portions of inner conductors 45 to 47 from each other. A microwave energy coupling device 50 is provided which forms a loop 51 within the interior of the structure 40 to radiate input energy through the space inside the enclosed structure. The input energy will propagate through the space unobstructed by the shielding plates, while causing resonance to occur along each of the inner conductors. The inner conductors have their smaller and larger diameter portions so dimensioned as to provide different resonant frequencies within the desired range of a passband. The wanted signal is extracted from an output 52 provided on the side wall 44, the output having a loop 53 constructed in the same manner as the input coupling means 50.

Figure 5:
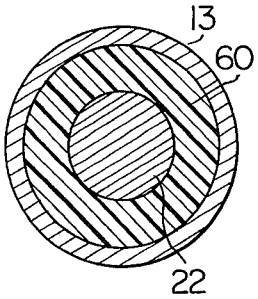
FIG. 5 is a cross-sectional view taken along lines 5—5 of FIG. 4.
Figure 4:
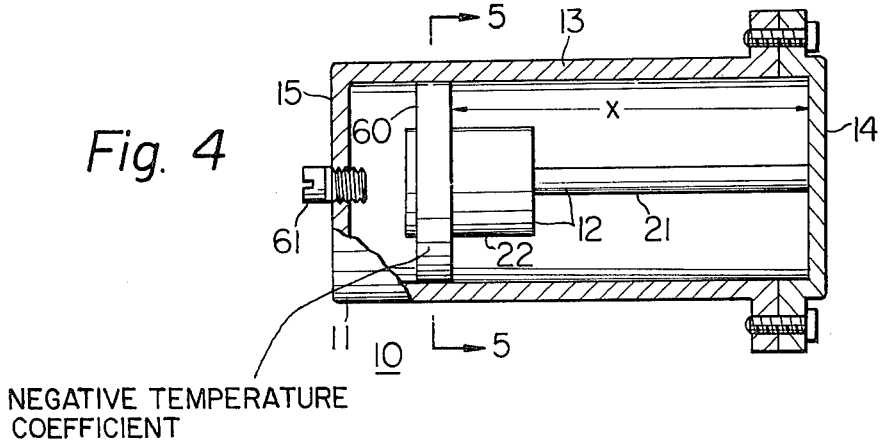
FIG. 4 is another embodiment of the invention.

In accordance with a second aspect of the present invention, the resonator 10 further comprises an annular temperature compensation element 60 constructed of a dielectric material of which the dielectric constant has a negative temperature coefficient, as shown in FIGS. 4 and 5. Teflon (Trademark of Du Pont for Polytetrafluoroethylene resin) possesses the negative temperature characteristic. The distributed inductances and capacitances of the inner conductor 12 corresponding to its smaller and larger diameter portions respectively, have the tendency to vary in magnitude under the influence of temperature variations, and hence the resonant frequency. The Teflon-made annular body 60 has a predetermined thickness along the axial direction of the inner conductor 12 and is mounted to encircle the larger diameter portion 22 and extends transversely to the inner walls of the outer conductor 11. Let L and C denote the inductive and capacitive values of the portions 21 and 22 of inner conductor, respectively, and the subscript "o" denote the respective values at the minimum temperature, the following equations hold:

$$L(T) \simeq L_o(1 + \alpha\Delta 6\, T) \quad (6)$$

$$C(T) \simeq C_o(1 + \gamma\Delta T) \quad (7)$$

where $T$ is the temperature in resonator, $\alpha$, the coefficient of linear expansion of the inner and outer conductors, and $\gamma$ is expressed as follows:

$$\alpha = 2\alpha - \delta \frac{\Delta C_o}{C_o} \quad (8)$$

where $\delta$ is the temperature coefficient of the dielectric body 60, and $\Delta C$ is the increment of capacitance C due to the provision of dielectric body 60. Since the resonant frequency $f$ is given by $$f = \frac{1}{2\pi\sqrt{LC}} \quad (9)$$

therefore, $$f(T) \simeq f_o\{1 - \tfrac{1}{2}(\alpha + \gamma)\Delta T\} \quad (10)$$

From Equation (10) it follows that in order to maintain the resonant frequency constant, it is necessary that the following relation should hold:

$$\alpha + \gamma = 0 \quad (11)$$

Therefore, the following equation should be satisfied:

$$3\alpha - \delta\frac{\Delta C_o}{C_o} = 0 \quad (12)$$

$$\Delta C_o = \frac{3\,\Delta C_o}{\delta} \quad (13)$$

Since $\Delta C_o$ is dependent on the volume of dielectric body 60, the optimum thickness can be determined.

Figure 7:
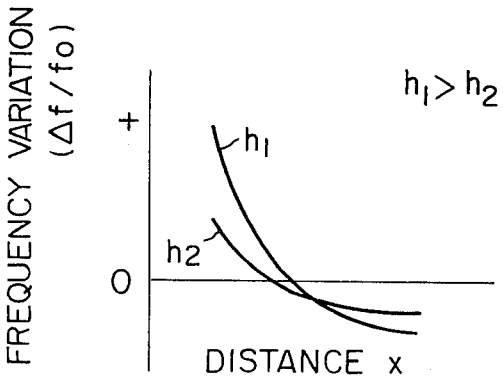
FIG. 7 is a graph illustrating the frequency variation as a function of the distance between the dielectric temperature compensator and the end member connected to the inner conductor.

Temperature compensation is also effected by suitably locating the dielectric annular body 60 relative to the end plate 14. FIG. 7 shows the frequency variation ($\Delta f/f_o$) versus the spacing between the dielectric body 60 and end plate 14 for different thickness $h_1$ and $h_2$ of the dielectric element 60 as parameters shown in curves which intersect the zero axis at different spacings. The resonator can thus be made insensitive to temperature variation when the dielectric element is spaced a predetermined distance from the end plate 14 for a particular thickness.

The dielectric temperature compensation element 60 having negative temperature characteristic and so fitted in the spacing between the larger diameter portion 22 and the inner surface of outer conductor 11, has the effect of supporting the open end of the inner conductor 12 to provide structural integrity so that the resonator as a whole becomes immune to mechanical vibration or shock.

In the embodiment of FIG. 4, the end plate or wall 15 includes an adjustment screw 61 which extends into the interior of the cavity resonator in confrontation with the open end face of the inner conductor 12. The turning of the adjustment screw 61 changes the effective spacing between the end wall 15 and the open end of inner conductor 12 to vary the lumped capacitive value of the resonator so that fine tuning of the resonator is achieved.

What is claimed is:

1. A cavity resonator comprising, an enclosure having opposed ends, a center cylindrical conductive body in the enclosure and shaped into first and second portions having respective characteristic impedances, the first portion being in short-circuit connection with one of said ends of the enclosure and having a larger characteristic impedance than said second portion, said second portion being in open-circuit relation with the other end of the enclosure, and a body of dielectric material encircling said second portion of the center conductive body, the dielectric constant of said material having a negative temperature coefficient.

2. A cavity resonator as claimed in claim 1, wherein said first and second portions of the center conductive body have respective first and second transverse dimensions, said first portion having a smaller transverse dimension than said second portion.

3. A cavity resonator as claimed in claim 1, wherein said enclosure comprises a tubular body.

4. A cavity resonator as claimed in claim 1, wherein said dielectric body has an axial dimension determined in relation to the value of said negative temperature coefficient to provide temperature compensation.

5. A cavity resonator as claimed in claim 1, wherein said dielectric body is located at a predetermined distance from said one end of the enclosure to provide temperature compensation.

6. A cavity resonator as claimed in claim 1, further comprising means in said other end of the enclosure to adjust the effective spacing between said other end and the open end of said second portion of the center conductive body.

7. A coaxial cavity resonator comprising, an enclosed cylindrical outer conductor having opposite end walls, an inner cylindrical conductor coaxial with the outer conductor and having stepped first and second portions in the direction of propagation of microwave energy, said first portion being between said second portion and one of said end walls and having distributed inductances, said second portions having distributed capacitances and spaced from the other of said end walls to form a lumped capacitance therebetween, and a body of dielectric material surrounding said second portion, the dielectric constant of said material having a negative temperature coefficient.

8. A coaxial cavity resonator as claimed in claim 7, wherein the value of said distributed capacitances is much larger than the value of said lumped capacitance.

9. A coaxial cavity resonator as claimed in claim 7, wherein said first portion of the inner conductor is in short-circuit connection with said one end wall of the outer conductor.

10. A microwave circuit component comprising, an outer conductor defining a cavity therein, an inner cylindrical conductor shaped into first and second portions having respective first and second transverse dimensions, means for coupling microwave energy to the outer and inner conductors to permit same to propagate axially through said cavity, said first portion being in electrical contact with the outer conductor to provide short-circuit reflection of the microwave energy from the point of said contact and having smaller transverse dimensions than said second portion, said second portion being in open-circuit relation with the outer conductor to provide open-circuit reflection of the microwave energy from the end thereof opposite to the first portion, means for connection to an external circuit for extracting the microwave energy from said cavity, said first and second portions being axially and transversely dimensioned to provide resonance at a predetermined microwave frequency, and a dielectric body having a dielectric constant with a negative temperature coefficient disposed to circumferentially encircle a part of said second portion.

* * * * *